United States Patent [19]

Ford et al.

[11] Patent Number: 4,500,379

[45] Date of Patent: Feb. 19, 1985

[54] METHOD OF MAKING A COMPOSITE FIBER REINFORCED PLASTIC FRAME

[75] Inventors: James M. Ford; Robert A. Dean; Kenneth E. Woodard, Jr., all of Cleveland, Tenn.; Antonio Branco, Prospect, Ky.

[73] Assignee: Olin Corporation, Cheshire, Conn.

[21] Appl. No.: 526,309

[22] Filed: Aug. 25, 1983

Related U.S. Application Data

[62] Division of Ser. No. 402,200, Jul. 26, 1982, Pat. No. 4,439,298.

[51] Int. Cl.[3] ..... B65H 81/00

[52] U.S. Cl. ..... 156/172; 156/298; 156/303.1

[58] Field of Search ..... 156/172, 173, 175, 169, 156/298, 303.1, 300; 204/286, 227 R, 227 W; 428/83, 375, 377, 327, 131, 188, 113; 52/633, 634, 656, 661

[56] References Cited

U.S. PATENT DOCUMENTS

| | | | |
|---|---|---|---|
| 2,858,263 | 10/1958 | Lucas et al. | 204/256 |
| 2,877,501 | 3/1959 | Bradt | 264/143 |
| 3,252,883 | 5/1966 | Schick | 204/279 |
| 3,312,314 | 4/1967 | Schick | 204/266 |
| 3,415,733 | 12/1968 | Hans et al. | 204/279 |
| 3,549,444 | 12/1970 | Katz | 156/175 |
| 3,551,237 | 12/1970 | Cox et al. | 156/175 |
| 3,778,362 | 12/1973 | Wiecher et al. | 204/254 |
| 3,836,448 | 9/1974 | Bouy et al. | 204/270 |
| 3,849,279 | 11/1974 | Barkel | 204/254 |
| 3,864,236 | 2/1975 | Lindstrom | 204/265 |
| 3,869,375 | 3/1975 | Ono et al. | 204/301 |
| 3,923,630 | 12/1975 | Argade et al. | 204/266 |
| 4,040,935 | 8/1977 | Argade et al. | 204/256 |
| 4,045,325 | 8/1977 | Schwickart et al. | 204/286 |
| 4,051,009 | 9/1977 | Schweichkart et al. | 204/272 |
| 4,069,122 | 1/1978 | Sato et al. | 204/258 |
| 4,107,023 | 8/1978 | Mentz | 204/269 |
| 4,139,448 | 2/1979 | Wallace | 204/256 |
| 4,149,952 | 4/1979 | Sato et al. | 204/258 |
| 4,188,464 | 2/1980 | Adams et al. | 204/289 F |
| 4,195,113 | 3/1980 | Brook | 428/375 |
| 4,220,686 | 9/1980 | Brook | 428/375 |
| 4,315,810 | 2/1982 | Kircher et al. | 204/269 |
| 4,402,813 | 9/1983 | Kircher et al. | 204/286 |

*Primary Examiner*—Michael Ball

*Attorney, Agent, or Firm*—Ralph D'Alessandro; Donald F. Clements; Thomas P. O'Day

[57] ABSTRACT

A composite fiber reinforced plastic frame is provided wherein a core material at least partially formed from the continuous wrapping of roved layers of glass fiber impregnated with a catalyzed thermosetting resin within a corrosion resistant liner and the frame is reinforced at the corners.

4 Claims, 5 Drawing Figures

METHOD OF MAKING A COMPOSITE FIBER REINFORCED PLASTIC FRAME

This is a division of application Ser. No. 402,200, filed July 26, 1982, now U.S. Pat. No. 4,439,298.

BACKGROUND OF THE INVENTION

The present invention relates generally to electrode frames used in electrolytic cells. More specifically, the present invention relates to an improved composite fiber reinforced plastic frame that may be employed in monopolar filter press type of membrane electrolytic cells, especially those used to produce chlorine and caustic.

Chlorine and caustic, products of the electrolytic process, are base chemicals which have become large volume commodities in the industrialized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type of electrolytic cell or the flowing mercury cathode-type of cell.

The development of a hydraulically impermeable membrane has promoted the advent of commercial filter press membrane chloralkali cells which produce a relatively uncontaminated caustic product. This higher purity product can obviate the need for caustic purification and concentration processes. The use of a hydraulically impermeable planar membrane has been most common in bipolar filter press membrane electrolytic cells. However, advances continue to be made in the development of monopolar filter press membrane cells which have caused increasing attention to be focused on the development of improved and more economical electrodes and electrode frames.

Early filter press membrane cells were constructed of heavy plastic frames. Typically, these cells were bipolar and utilized a solid sheet or backplate which was a divider between the cells and was fabricated integrally with the frame. Bipolar cells of this type followed well developed filter press membrane fabrication principles. The integral frame-backplate construction provided excellent stiffening of the frame structure. The backplate frequently was covered with a resin or rubber coating that was not readily attacked by the chlorinated brine. The frames for these cells were molded from hard rubber and filled with polypropylene or molded of polyester or any other material that was chemically inert. Frequently, the anode frame was formed of these materials while the cathode frame either was made from the same materials or was formed from steel.

The bipolar filter press membrane cell frames tended to be limited in size for several reasons. These included the high cost for very large molds and the warping that tended to occur in the heavy plastic frames when the frames were subjected to operating temperatures during actual cell use. Additionally, the plastic parts employed in these cells tended to have a high coefficient of expansion compared to the metal parts. This resulted in a disparity in expansion between the cell parts during operation that tended to cause distortion. Also, the filled plastic frames were susceptible to corrosion by the chlorine, especially in the filler material. Lastly, the presence of calcium and magnesium in these plastic frames was found to be inappropriate when membranes were used because of the adverse affect on membrane life.

Thus, monopolar filter press membrane cells, as well as bipolar filter press membrane cells, normally have employed metal frames. Typically, these metal frames have used titanium in the anodic electrode and iron or nickel in the cathodic electrode. This metal frame construction offered the advantages of high strength, small cross section of structural members, corrosion resistance, resistance to warping, large size and compatibility with metal electrode surfaces. However, the single most notable disadvantage of metal frames is their very high fabrication cost. Metals such as titanium and nickel, and the fabricating facilities as necessary to produce the electrode frames, are particularly susceptible to the soaring costs associated with high technology.

Therefore, attempts continue to employ plastic frames in filter press membrane cells that will give the advantages that metal frames offer without the high costs. Pultruded members of fiberglass polyester resin offer the advantages of low cost, low coefficient to thermal expansion similar to those of metal, and high strength. However, this type of plastic frame construction is deficient because of inadequate corrosion resistance and the difficulty of obtaining strong, leak-free, corrosion-resistant corner joints.

Where composite fiber reinforced plastic frames with resin impregnated glass fiber core material wound within a chemically resistant thermoplastic liner have been employed, high stress levels have been found to exist in the glass fibers at the corners of the frames. This high stress is the result of the resin being pressed off of the glass fibers at the frame corners because of the manner in which the glass fibers are wound onto the frames. Frames are rotated on a rotatable jig.

The foregoing problems are solved in the design of the composite fiber reinforced plastic frames of the present invention.

SUMMARY OF THE INVENTION

It is an object of the present invention to provide a frame for use in a filter press membrane type of electrolytic cell that incorporates a corrosion resistant liner with an inexpensive, but high strength structural core.

It is another object of the present invention to provide a frame for use in a filter press membrane type of electrolytic cell that is made of a composite fiber reinforced plastic which is reinforced at its corners.

It is another object of the present invention to provide a method of making the composite fiber reinforced plastic frame for use in a monopolar filter press membrane type of electrolytic cell.

It is a feature of the present invention that the glass fiber impregnated with a catalyzed polyester resin wrapped in a roving fashion within the shell frame roving is reinforced with pultruded strips of fiber reinforced plastic that are joined in stepped interlocking fashion at the corners.

It is a feature of an alternate embodiment of the present invention that the glass fiber impregnated with a catalyzed polyester resin wrapped in a roving fashion within the shell frame is reinforced at its corners by a plurality of angled spacer members.

It is a feature of the method of making the composite plastic frame of the present invention that a rotatable jig is employed to which the shell frame is mounted.

It is an advantage of the present invention that the composite fiber reinforced frame is strengthened at its corners.

It is another advantage of the present invention that the thermoplastic corrosion resistant liner material provides a smooth gasket face for use in assembled filter press membrane type of electrolytic cells.

These and other objects, features, and advantages, are obtained in a composite fiber reinforced plastic frame and the method of making such a frame by providing reinforcing members at the corners of the frame to reinforce the corners where the glass fibers that are wound about the frame in roved layers are sufficiently stressed to squeeze the catalyzed polyester resin therefrom at the corners.

BRIEF DESCRIPTION OF THE DRAWINGS

The advantages of this invention will become apparent upon consideration of the following disclosure of the invention, especially when it is taken in conjunction with the accompanying drawings wherein.

DETAILED DESCRIPTION OF THE PREFERRED EMBODIMENT

Figure 1:
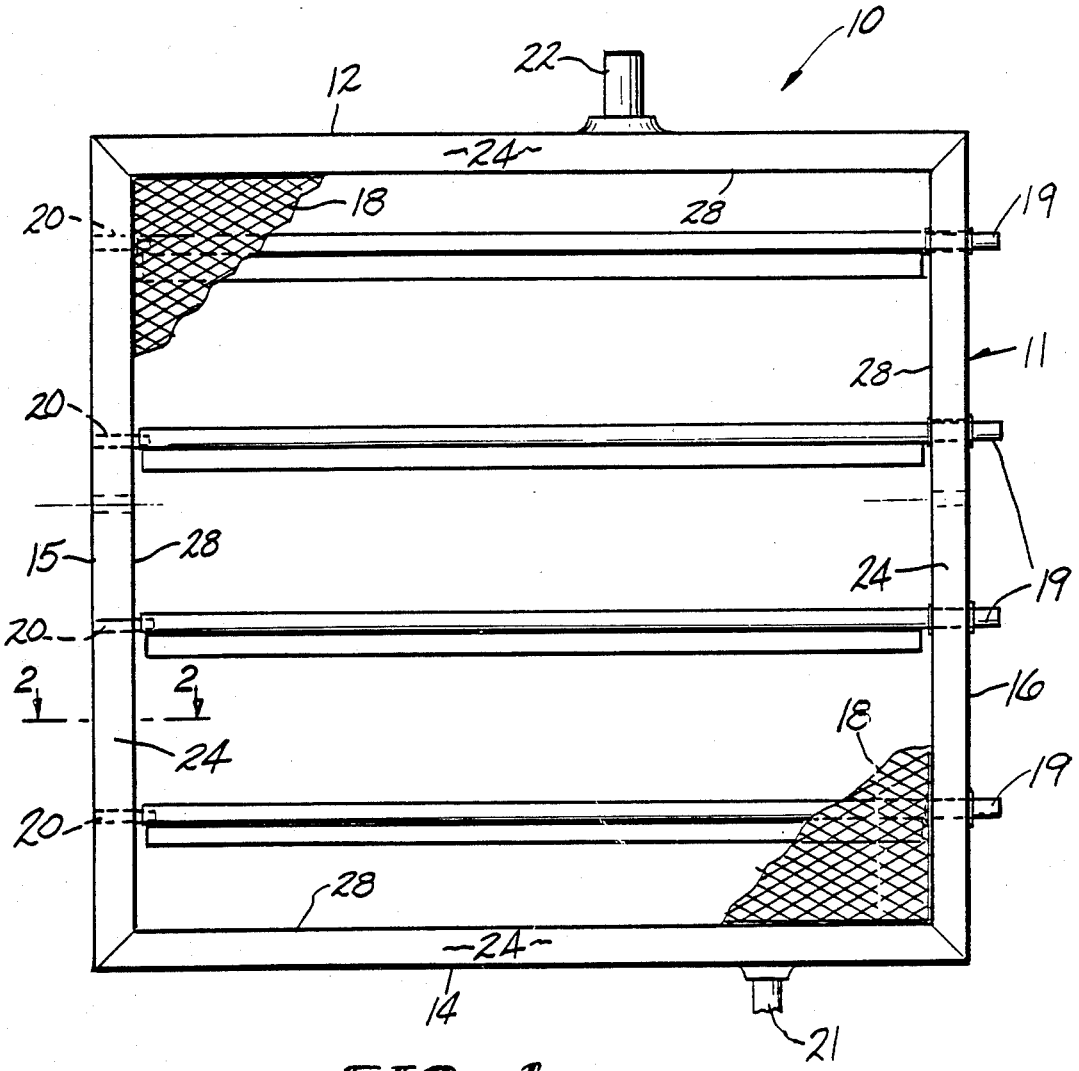
FIG. 1 is a side elevational view of a monopolar electrode adaptable for use in a filter press membrane type of electrolytic cell having the electrode surfaces broken away.

Looking at FIG. 1, an electrode indicated generally by the numeral 10 is shown. The electrode may be either an anode or a cathode, depending upon the materials employed at specific locations. It is intended that the term electrode encompass all of the elements and components normally associated with an electrode unit that is assembled in a filter press membrane type of electrolytic cell, including opposing electrode surfaces, conductor rods, process inlet and process outlet means.

Electrode 10 is shown to include a generally rectangular outer frame, indicated generally by the numeral 11. Frame 11 is comprised of four separate members, specifically a top member 12, a bottom member 14, a first generally vertically oriented side member 15 and opposing second generally vertical side member 16. Opposing electrode surfaces 18, only partially shown, are mounted to the electrode frame by being appropriately fastened, such as by welding, to the conductor rods 19. Conductor rods 19 pass through predrilled holes or openings in an appropriate side of the frame 11 and extend generally horizontally thereacross.

Conductor rods 19 may be flanged to make internal seals on the inner faces 28 of side members 15 and 16 or may be grooved on one end and collared on the opposing end to permit the use of O-rings to extending through the side member 16 are the current leads to the cell. These are connectable to cell terminals (not shown) in an assembled filter press membrane electrolytic cell. At the opposite ends of the conductor rods 19, capscrews 20 are inserted through side member 15 and are screwed into female threaded end portions (not shown) of the conductor rods 19. The conductor rods 19 likewise hold and seal side members 16 by means of externally threaded nuts that are screwed onto the outer ends of conductor rods 19.

A process inlet means 21 is shown entering the frame 11 through the bottom member 14. A process outlet means 22 is similarly shown in the top member 12. The process inlet means 21 and the process outlet means 22 serve to carry the electrolyte and entrained product gas through the electrode compartment (not shown) that is generally defined in assembled cell by the pair of membranes that are placed adjacent, but exteriorly of each electrode's two opposing surfaces 18. The inlet process means 21 may connect to an infeed manifold or header (not shown) through which fresh brine, in the anode, and deionized water and caustic, in the cathode, are fed. The process outlet means 22 leads to a gas-liquid disengager (not shown) into which chlorine gas and anolyte, in the case of the anode, and hydrogen gas and caustic, in the case of the cathode, are released.

Figure 2:
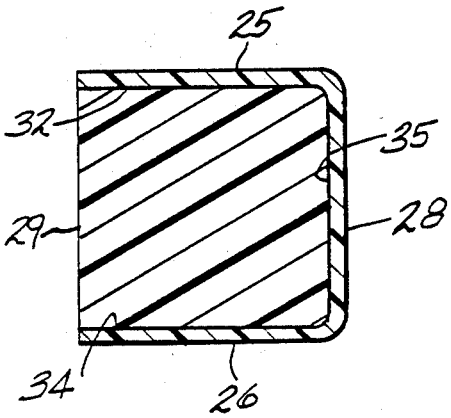
FIG. 2 is a sectional view taken along the lines 2—2 of FIG. 1 showing one embodiment of the frame member structure.

A corrosion resistant liner material 24 is seen surrounding the outer portions of the frame 11 in FIG. 1. FIG. 2 shows in more detailed fashion the placement of the liner material 24 of FIG. 1 on the individual members of the frame 11. In FIG. 2, the liner material 24 is shown having a first side face 25 and an opposing second side face 26 interconnected by a third side face 28. Within the open-topped channel that is formed by the side faces 25, 26, and 28, a core material 29 is emplaced. The core material 29 is of a predetermined width or thickness that is equal to the width of the channel formed by the side faces 25, 26, and 28. Preferably, the core material 29 is formed from resin impregnated glass fiber roving that is applied continuously in layers wrapped around all four sides of the frame 11. The resin is a catalyzed thermosetting resin, such as a polyether or polyester resin. An epoxy resin could also be employed.

Alternate configurations of filler may be used in the channel formed by the side faces 25, 26, and 28 to reduce the amount of heat that builds up in the frame 11 during the curing of the resin. High heat build up can cause the liner material 24 to warp and can be reduced by the use of a filler material interspersed or inserted between the layers of resin impregnated glass fiber. Suitable filler material is pultruded fiber reinforced plastic. FIG. 5 shows a multi-layered laminate between the side faces 25, 26, and 28. The core material 29 has placed, in alternating fashion between its layers, strips of fiber reinforced plastic 31. While the pultruded fiber reinforced plastic strips 31 of FIG. 5 are shown being a distance less than the width of the channel, they could equally well extend across the full width of the channel. Either of the configurations are interchangeable. The reinforced plastic strips 31 are generally pultruded and extend along substantially the entire length of each individual member of the frame 11, as is best seen in FIG. 4.

The core material 29, as has been previously described, is preferably formed from glass fiber roving and is impregnated with a catalyzed thermosetting resin. This is formed by passing glass fiber through a resin bath prior to its being positioned within the shell frame 11. The impregnated glass fiber is then wound about the top member 12, the first side member 15, the bottom member 14, and the second side member 16, and in layered roving fashion. Where the embodiment of FIGS. 4 and 5 is employed, a predetermined amount of the glass fiber rovings is wound in layers, into the shell frame 11, a strip of the pultruded fiber reinforced plastic is inserted within each member 12, 14, 15. 16 of the frame 11. This procedure is continued until the desired number of strips 31 are employed. For the embodiments best shown in FIG. 2 and FIG. 5, a final layer of core material 29, such as the resin impregnated glass fiber, is then wound about the frame 11 until the core material 29 is at least flush with the open-topped channel between the side faces 25 and 26. After the resin is cured, excess core material 29 may be removed by appropriate trimming.

Figure 3:
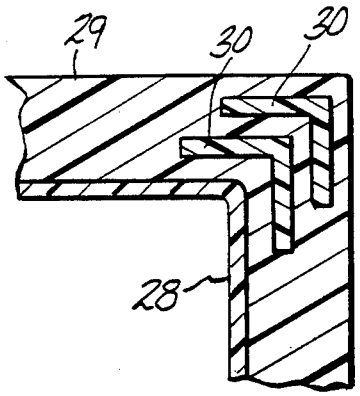
FIG. 3 is a partial side elevational view of a section at a corner of a frame showing the reinforcing angled spacer members.

Reinforcing means in the form of angled members 30 of FIG. 3 are employed in the core material 29 in frame 11 which is constructed with glass fiber roving that is impregnated with a catalyzed thermosetting resin. These angled members 30 strengthen the frame 11 at the corners where individual top and bottom members 12 and 14, respectively, and the side members 15 and 16 are mitred and joined together at a plurality of junctions. Since the glass fiber is continuously wound within the shell frame 11, the resin tends to be pressed off of the fibers at these corners, resulting in high stress levels after the resin has cured. The angled members 30, which are formed by approximately right-angled legs, are inserted between the layers of resin impregnated glass fiber rovings at each of the four corners in numbers varying from two to about four. These angled members 30 may either extend completely across the open-topped channel formed by the first side face 25, the opposing second side face 26, and the interconnecting side face 28 of the liner material 24, thus touching the side faces 25 and 26. Alternatively, they may extend some distance less than the distance between the side faces 25 and 26 in a manner similar to that of the fiber reinforced plastic strips 31 seen in FIG. 5. The angled members 30 are formed from fiber reinforced plastic legs of predetermined length and may be either tapered or of uniform thickness.

Figure 4:
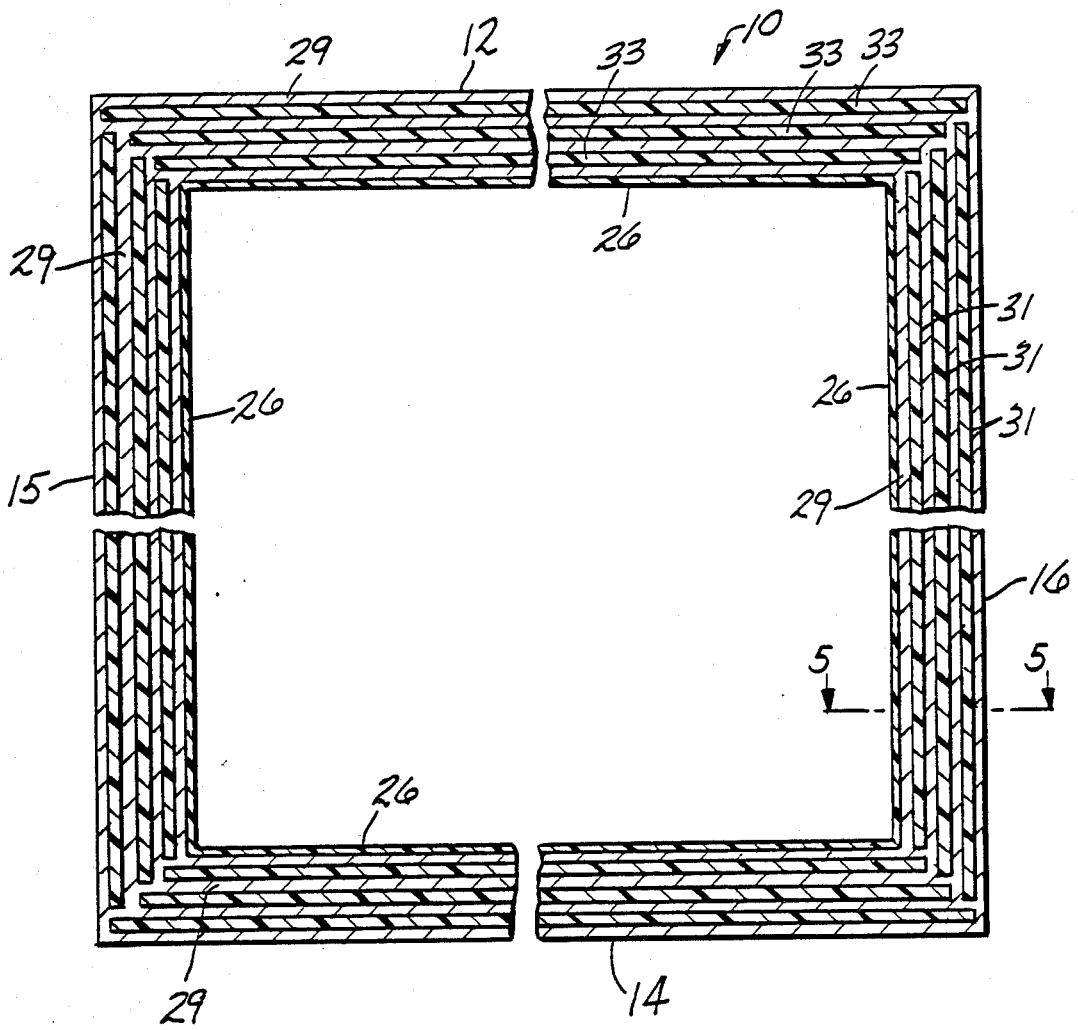
FIG. 4 is a partial side elevational view of a sectional frame showing the stepped interlock pattern of the pultruded fiber reinforced strips.
Figure 5:
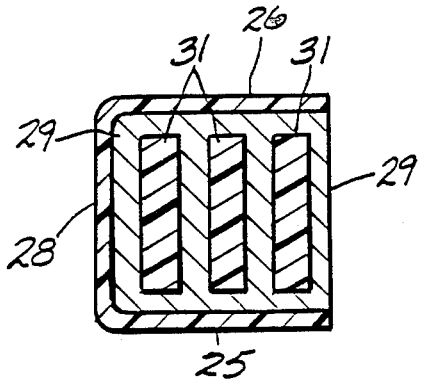
FIG. 5 is a sectional view taken along the lines 5—5 of FIG. 4 showing the layers of the pultruded fiber reinforced plastic strips in a frame.

An alternative reinforcing means is shown in FIGS. 4 and 5 where the elongate fiber reinforced plastic strips 31 are positioned in stepped interlocking fashion at the corners or junctions where the individual top and bottom members 12 and 14, respectively, and the side members 15 and 16 are joined together. The stepped interlock reinforcement is best seen in FIG. 4 where each generally vertically extending fiber reinforced plastic strip 31 is lapped or bounded by the corresponding generally horizontally extending fiber reinforced plastic strips 31 in the top member 12 and the bottom member 14. This stepped interlock pattern at the corners provides the same type of reinforcement as the angled members 30.

A lining material (not shown) is inserted within each hole that is drilled through any of the members of the frame 11. Specifically, this lining material is applied to locations where holes are drilled through the second side member 16 for the passage of each of the conductor rods 19, as well as for the holes passed through the top member 12 and the bottom member 14 for the process outlet means 22 and the process outlet means 21, respectively. The material for the lining material (not shown) is the same material as is used in the liner material 24 which will be discussed in greater detail. Appropriate adhesives may be employed to bond the lining material 36 to the core material 29 and liner material 24, which is clad thereto. The lining material (not shown) within each hole is heat welded to the liner material 24 to make a liquid-tight seal.

Similarly, the individual members 12, 14, 15 and 16 of the frame 11 may employ an adhesive to promote the cladding of the liner material 24 to the core material 29 and any pultruded fiber reinforcement strips 31. As best seen in FIG. 2, the first side face inner surface 32, the second side face inner surface 34, and the third side face inner surface 35 provide surface area on which the appropriate adhesive may be placed prior to the roving and winding of the core material 29 into the empty channel of the shell frame 11. An appropriate adhesive material has been found to be commercially available from Ashland Chemical Company and sold under the name CRYSTIC 392. This adhesive is especially useful with liner material made from chlorinated polyvinyl chloride.

The liner material 24 will vary depending upon whether the particular electrode is to be used as an anode or a cathode. Where electrodes will be employed as an anode, it has been found that the preferred liner material 24 is made from polyvinylidene fluoride (PVDF). Alternate materials may include chlorinated polyvinyl chloride (CPVC). The PVDF has been found to be more resistant to chlorine and therefore is especially desirable for use in chloralkali cell applications. Where the electrode is used as the cathode, the preferred liner material 24 has been found to be CPVC since it is resistant to caustic. The distinguishing characteristics must be the use of a material which is resistant to chlorine or caustic, as appropriate, and can withstand operating temperatures of approximately 90° C. Other thermoplastic materials resistant to caustic or chlorine, as appropriate, may also be employed as a suitable liner material 24, such as polypropylene, olefin acrylonitrile styrene sold commercially by Uniroyal under the trademark ROVEL®, polysulfone, and polyfluorinated hydrocarbons selected from the group of polytetrafluoroethylene (PTFE), fluorinated ethylene propylene (FEP), perfluoroalkoxy sold commercially under the trademark Teflon® PFA, ethylene tetrafluoroethylene sold commercially under the trademark Teflon® ETFE, polyvinylidene fluoride polyester sold commercially under the trademark "KYNAR" and ethylenetetrafluoroethylene resins such as that sold by Asahi Glass Company under the trademark Aflon® COP. Polychlorinated hydrocarbons may also be used, in addition to CPVC, such as ethylene chlorotrifluoroethylene (E-CTFE). However, in all cases, presence of calcium, magnesium, and iron should be minimized to avoid detrimental effect to the membranes utilized in the fully assembled filter press membrane type of electrolytic cell.

Certain liner materials 24, such as PVDF, are vewry difficult to bond with adhesives. Hence, special grades of material are used in which bonding layers of polyester mat or glass fiber mat are pressed into one surface during manufacture. The incorporation of such a mat into the liner material 24 of the frame 11 permits a strong bond to be obtained between the core material 29 and the PVDF liner material 24.

The electrodes 10 can be of varying sizes, with side and top member lengths varying in length from about 20 inches to about 200 inches. The more commonly employed member lengths vary from about 40 inches to about 80 inches, while the preferred lengths are from about 42 inches to about 45 inches. The electrodes 10 can be either rectangular or square in shape.

The side and top members 15, 16, 12 and 14, respectively, may have cross section side dimensions that vary from about ½ inch to about 6 inches. The more common cross section dimensions vary from about 1 inch to about 3 inches. The preferred size has been about 2 inches by about 2 inches in section for each member.

The electrode surfaces 18 are appropriately connected to the conductor rods 19, such as by welding at selected locations. Once connected the entire electrode surface-conductor rod assembly is removably inserted into the generally rectangular or square hollow center section formed by the frame 11. The electrode surfaces 18 are those standardly employed in the industry for use in anodic or cathodic conditions.

The conductor rods 19 are about ½ inch to about 3 inches in diameter. The preferred size is about 1 inch in diameter. The conductor rods 19 are copper with titanium or nickel coatings for use in an anode or a cathode, as appropriate.

A gasket (not shown) may be employed between adjacent electrodes in an assembled cell by machining a suitably depthed groove, such as approximately 1/16 inch deep and approximately ½ inch wide, in the liner material 24 of the cathode and placing an O-ring gasket of approximately ⅛ inch diameter therein. The liner material 24 is approximately ⅛ inch in thickness. Alternate assemblies may use no gaskets or gaskets with no grooves in the cathode liner material 24. Where no gaskets are employed the liner material 24 possesses sufficient resiliency to obviate the need for gaskets by compressing tightly enough between adjacent frames to effect liquid-tight seals in an assembled cell. Where gaskets with no grooves in the cathode liner material 24 are employed in an assembled cell, the gaskets are placed flush against the appropriate side faces of the frames 11.

The frames 11 of the instant invention are made by selecting a thin, heated-weldable, corrosion-resistant liner material 24 to cover the two opposing side faces, 25 and 26, and the interconnecting interior side face 28. The shell frame formed by the heat welding of the corners of the liner material 24 is then mounted on a rotatable jig so that the open-topped frame 11 has the open-topped portion facing outwardly about its entire periphery. The jig may be made from appropriate materials, such as two pieces of plywood or metal plates of appropriate thickness with accurately machined inner surfaces bolted together with spacers to give the desired frame member thickness. An axle member projects through the center of the opposing plates to permit the jig to rotate. The liner material 24 is sufficiently flexible to permit the frame members with its core material 29.to expand outwardly to confrom to the shape of the mold formed by the jig. Glass fibers pass from rolls of tow through a tray filled with resin. The resin impregnated glass fiber is then wound in rovings into the channel formed by the open-topped U-shaped shell frame 11 as the frame is rotated with the jig. The glass fiber impregnated into the catalyzed thermosetting resin is wound in roving fashion into the frame 11 until a predetermined thickness of the resin impregnated glass fiber is built up. Angled members 30 are inserted at each of the corners of the frame 11 and additional rovings of the catalyzed resin impregnated glass fiber are wound about the frame 11. This procedure is continued until the desired number of angled members 30 are placed at each corner and the resin impregnated glass is generally flush with the tops of the first side face 25 and the opposing second side face 26.

Where a plurality of pultruded fiber reinforced plastic strips 31 are employed, the pultrusions are positioned appropriately within the channel formed by the shell frame 11. The strips 31 are positioned in stepped interlocking fashion at the corners where the generally horizontal top and bottom members 12 and 14 and the generally vertical side members 15 and 16 join. Additional rovings of resin impregnated glass fiber are then placed on top of the pultruded fiber reinforced plastic strips 31. Additional strips 31 are dispersed between the layers of resin impregnated glass fiber rovings until the depth of core material 29 is generally flush with the tops of the aforementioned first side face 25 and opposing second side face 26.

When the desired depth of core material 29 has been achieved, plates are clamped in place against the open-topped side to exert a predetermined amount of pressure on the core material 29 during its curing process. A layer of cellophane or polyethylene sheet between the plate and the resin impregnated glass fiber may be employed to prevent adherence of the resin to the pressure plate. Preferably, the core material 29 is permitted to cure at ambient temperature. The core material 29 generally hardens within about 1 hour, but is preferably allowed to cure over a 24 hour period. Alternately, a different resin formulation may be employed that requires heating in an oven so that annealing of the liner material 24 and curing of the core material 29 may be simultaneously accomplished. After the core material 29 is cured, the frame 11 is removed from the jig. Frame 11 with the core material 29 is then trimmed of any excess to provide a smooth exterior or periphery. The thermoplastic side faces 25 and 26 of the frame 11 may be lightly machined to prepare a gasket face or groove as discussed above.

It should also be noted that the high ratio of glass fiber to resin in the core material 29 provides a frame 11 that is high strength and yet possesses a low coefficient of thermal expansion that is compatible with the expansion that occurs in the metal components of the electrode 10 during operation. The percentage by volume of glass fiber can be as high as approximately 80% or as low as approximately 45%. The preferred percentage is from approximately 60% to approximately 70%.

While the preferred structure in which the principles of the present invention have been incorporated is shown and described above, it is to be understood that the invention is not to be limited to the particular details thus presented, but in fact, widely different means may be employed in the practice of the broader aspects of this invention. It should also be noted that the reinforcing means of either embodiment could also be employed with a core material that is made from graphite, polyamide or of the type sold under the trademark Kelvar ®. The scope of the appended claims is intended to encompass all obvious changes in the details, materials, and arrangement of parts which will occur to one of skill in the art upon reading the disclosure.

What is claimed is:

1. A method of making a composite reinforced plastic frame for use in a monopolar filter press type of electrolytic cell comprising the steps of:

(a) selecting a corrosion resistant liner of predetermined thickness and composition, the liner further having a first side face, a second opposing generally parallel side face and a third side face interconnecting the first side face and the second side face face to thereby form an open-topped channel of predetermined thickness and height;

(b) fastening at least four predetermined lengths of the liner together at corners to form a generally rectangularly shaped shell frame having a top member, a bottom member, and two opposing side members, the shell frame further having the open-topped channel facing outwardly about the periphery;

(c) mounting the shell frame on a rotatable jig having uniformly spaced side walls and base walls;

(d) impregnating glass fiber roving with a catalyzed thermosetting resin;

(e) winding the impregnated glass fiber roving about the shell frame within the channel in layers while the frame is rotated on the jig;

(f) inserting reinforcing means during winding of the glass fiber roving at each corner of the frame;

(g) applying a predetermined amount of pressure against the impregnated glass fiber roving along the open-topped channel about the periphery;

(h) curing the impregnated glass fiber roving; and (i) removing the frame from the jig.

2. The method according to claim 1 further comprising inserting at least one strip of preformed fiber reinforced plastic as the reinforcing means between the layers of impregnated glass fiber roving in each length of liner, the strips being oriented in stepped interlock between each adjacent length.

3. The method according to claim 1 further comprising inserting at least one angled member as the reinforcing means at each corner between the layers of impregnated glass fiber roving.

4. The method according to claim 1 further comprising applying an adhesive to the interior or at least the first side face and the second side face of the lengths of liner forming the shell frame prior to winding the impregnated glass fiber roving about the shell frame.

* * * * *

UNITED STATES PATENT AND TRADEMARK OFFICE

CERTIFICATE OF CORRECTION

PATENT NO. : 4,500,379

DATED : February 19, 1985

INVENTOR(S) : Ford et al.

It is certified that error appears in the above-identified patent and that said Letters Patent is hereby corrected as shown below:

In column 3, at line 65 after "O-rings to" and before "extending" insert --seal the frame 11. The ends of the conductor rods 19--.

In column 6, at line 56 please delete "vewry" and insert --very--.

Signed and Sealed this

*Eleventh* Day of *June 1985*

[SEAL]

*Attest:*

DONALD J. QUIGG

*Attesting Officer* *Acting Commissioner of Patents and Trademarks*